US010448758B1

(12) United States Patent
Abel

(10) Patent No.: US 10,448,758 B1
(45) Date of Patent: Oct. 22, 2019

(54) TEMPORARY MERCHANDISER DISPLAY

(71) Applicant: Sonoco Development, Inc., Hartsville, SC (US)

(72) Inventor: Patrick Abel, Crescent Springs, KY (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 16/124,799

(22) Filed: Sep. 7, 2018

(51) Int. Cl.
*A47F 5/11* (2006.01)
*A47B 43/02* (2006.01)

(52) U.S. Cl.
CPC ..... *A47F 5/116* (2013.01); *A47B 43/02* (2013.01); *A47B 2230/16* (2013.01)

(58) Field of Classification Search
CPC ..... A47F 5/116; A47B 43/02
See application file for complete search history.

(56) References Cited

U.S. PATENT DOCUMENTS 3,628,842 A * 12/1971 Wright ..... A47B 43/02 312/234
4,618,115 A 10/1986 Belokin, Jr.
4,630,740 A 12/1986 Belokin, Jr.
4,854,246 A 8/1989 Belokin et al.
5,183,166 A 2/1993 Belokin, Jr. et al.
5,213,220 A 5/1993 McBride
5,315,936 A * 5/1994 Smith ..... A47F 5/116 108/165
5,443,168 A * 8/1995 Dyment ..... A47F 5/116 211/149
6,612,669 B2 * 9/2003 Grueneberg ..... A47B 43/02 108/165
7,007,615 B2 * 3/2006 Grueneberg ..... A47B 43/02 108/165
7,677,433 B2 3/2010 Little
7,703,864 B2 4/2010 Moser
8,157,112 B2 4/2012 Bojie et al.
8,485,370 B2 7/2013 Dewhurst
8,627,585 B2 1/2014 Herman et al.
8,857,633 B2 10/2014 Dewhurst
8,875,908 B2 11/2014 L'Hotel
9,211,021 B2 * 12/2015 Smith ..... A47F 5/116
9,844,282 B2 * 12/2017 Smith ..... A47F 5/116
9,907,414 B2 * 3/2018 Heuer ..... A47B 43/00
9,918,569 B1 3/2018 Abel
9,949,579 B1 * 4/2018 Frost ..... A47F 5/116
2004/0148825 A1 * 8/2004 Myers ..... A47F 5/116 40/124
2010/0006529 A1 1/2010 Groff et al.
2012/0305512 A1 12/2012 L'Hotel
2017/0238727 A1 * 8/2017 Ertl ..... B65D 5/5226
2017/0245661 A1 8/2017 Heuer

FOREIGN PATENT DOCUMENTS

DE 102011116238 A1 * 4/2013 ..... B65D 5/52
DE 202014106151 U1 * 2/2015 ..... A47F 5/116

* cited by examiner

*Primary Examiner* — Stanton L Krycinski
(74) *Attorney, Agent, or Firm* — Miller, Matthias & Hull LLP

(57) ABSTRACT

A display hutch is provided that can be made from three components adhered together to form a flat compact structure suitable for shipping. The compact structure can be positioned upright and quickly converted into the display hutch having uninterrupted side panels suitable for graphics. A top tray may be mounted on top.

12 Claims, 11 Drawing Sheets

TEMPORARY MERCHANDISER DISPLAY

BACKGROUND OF THE INVENTION

Field of the Invention

This disclosure relates to a merchandiser display hutch. More particularly, this disclosure relates to a display hutch made from three die cut blanks that can be assembled together to form a flat compact structure suitable for shipping. The compact structure can be positioned upright and quickly converted into a display hutch by pushing down on individual shelf members and top flaps. A top tray can be quickly assembled from a separate cut and scored blank and mounted on top of the hutch. The sides of the display hutch present large surfaces suitable for printing graphics.

Description of the Related Art

Floor stands (a.k.a. display hutches) having multiple shelves for supporting products are known. Typically, display hutches are made of multiple components and sometimes even require fasteners. Display hutches can also require complex assembly steps, and can be large even when knocked down. The present disclosure is designed to address these problems.

BRIEF SUMMARY OF THE INVENTION

The present disclosure relates to a display hutch that can be made from three components adhered together to form a flat compact structure suitable for shipping, plus a separate top tray that mounts on top of the display hutch. The compact structure can be positioned upright and converted into a display hutch by rotating inwardly (as by pushing) shelf panels and then folding down top flaps.

In one aspect of the disclosure a display hutch is provided comprising a front panel, a rear panel, a left side panel, a right side panel and one or more shelves. The front panel comprises a front panel body that defines a plurality of windows and one or more front shelf panels rotatably attached to the front panel body along front shelf fold lines. The front panel extends from a left front corner to a right front corner. Each front shelf panel has a front distal edge parallel to the front shelf fold line. The left side panel extends from the left front corner to a left rear corner. The right side panel extends from the right front corner to a right rear corner. The rear panel extends from the left rear corner to the right rear corner, and comprises a rear panel body that defines a plurality of windows and one or more rear shelf panels rotatably attached to the rear panel body along rear shelf fold lines. Each rear shelf panel has a rear distal edge parallel to the rear shelf fold line. Each shelf comprises one of the front shelf panels and one of the rear shelf panels. Front glue tabs are hingedly affixed to each front shelf panel. Rear glue tabs are hingedly affixed to each rear shelf panel. The hutch further comprises a top wall comprises one or more top flaps affixed to one or both of the front panel and the rear panel. The hutch further comprises an internal support comprising a vertically extending front rail adhered to each front glue tab and a vertically extending rear rail adhered to each rear glue tab.

In a refinement, the display hutch further comprises front tabs projecting upwardly from each front shelf fold line and rear tabs projecting upwardly from each rear shelf fold line.

In another refinement the front rail comprises a rear facing surface flush with the distal edge of each front shelf panel, and the rear rail comprises a front facing surface flush with the distal edge of each rear shelf panel. The front rail and the rear rail may abut each other along their respective rear and front facing surfaces.

The front distal edge of each front shelf panel may contact a corresponding rear distal edge of each rear shelf panel.

The front panel, the left side panel, the right side panel, the rear panel and the shelves may be formed from a single folded unitary first blank.

The front rail and the rear rail may each be formed from an identical blank.

Each side panel may be vertically bisected by a side panel fold line. The display hutch may be re-configurable from a first configuration in which the front panel, the side panels and the rear panel are squared up and form a right prism, and a second configuration in which the side panels are folded along their respective side panel fold lines and are sandwiched between the front panel and the rear panel.

The display hutch may further comprise a glue flap foldably attached to a panel selected from the group consisting of the front panel, the left side panel, the right side panel and the rear panel, and wherein the glue flap is affixed to a different panel selected from the group consisting of the front panel, the left side panel, the right side panel and the rear panel.

The display hutch may extend upward from a ground-contacting bottom edge. The internal support may contact the ground.

The display hutch may comprise a top tray affixed to the top wall. The top tray has a bottom wall comprising top tray tabs that fit within slots defined by the top wall.

In another aspect the disclosure relates to a method of assembling a display hutch comprising the steps of: adhering the front rail to the front glue tabs and adhering the rear rail to the rear glue tabs; adhering the glue flap to one of the front panel, the left side panel, the right side panel or the rear panel to create a folded and glued structure; positioning the folded and glued structure in an upright position on a ground surface and squaring up the folded and glued structure; rotating downwardly in unison the front shelf panels along the front shelf fold lines until the front rail contacts the ground; rotating downwardly in unison the rear shelf panels along the rear shelf fold lines until the rear rail contacts the ground; folding inwardly each of the front and rear top facing flaps until each is perpendicular to its respective front or rear main flap; and rotating the front top flap and the rear top flap inwardly about their respective top edge fold lines until each assumes a horizontal orientation.

DETAILED DESCRIPTION OF THE INVENTION

Figure 1:
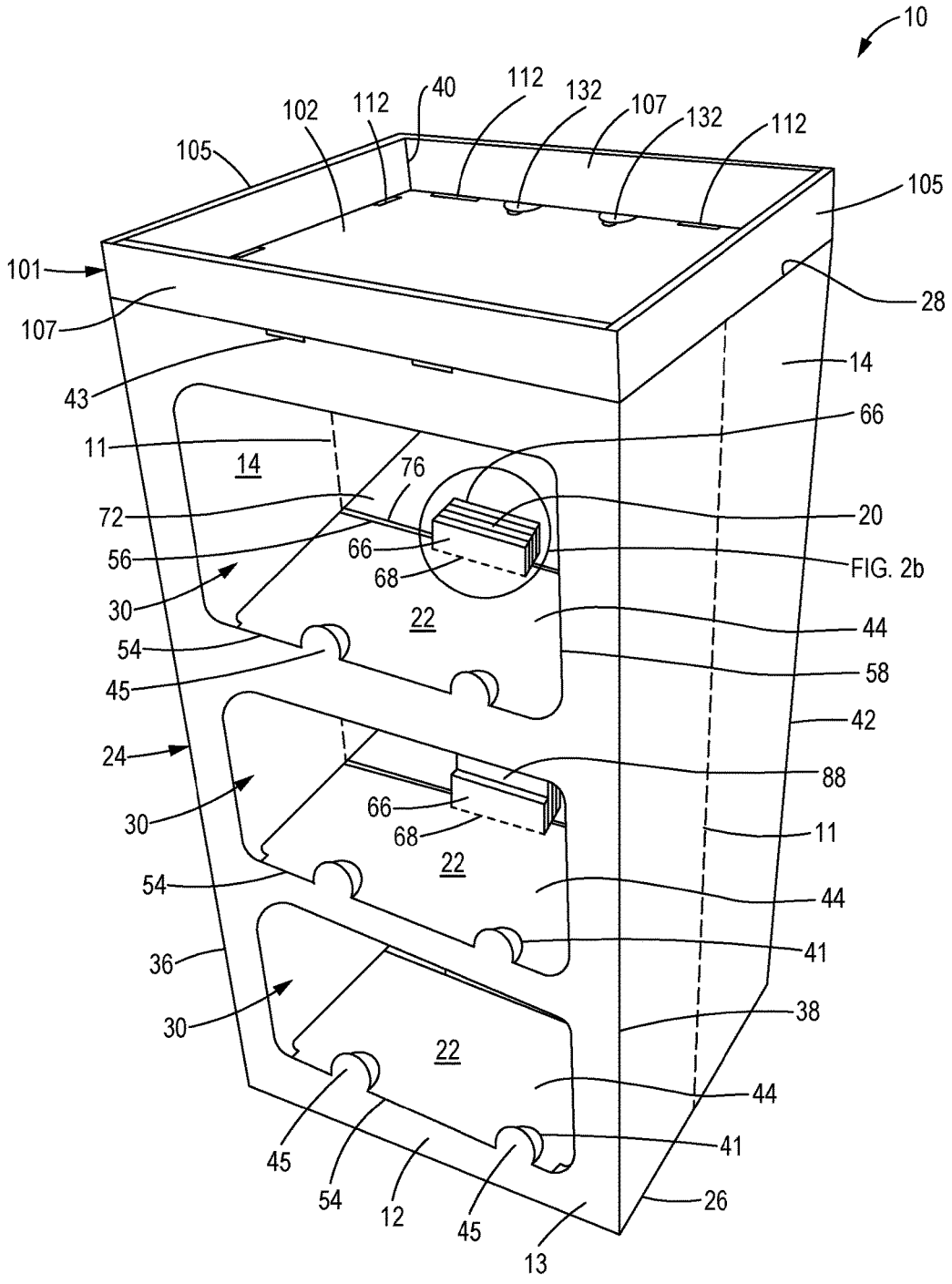
FIG. 1 is a perspective view of a display hutch with a top tray according to the disclosure.

While the invention described herein may be embodied in many forms, there is shown in the drawings and will herein be described in detail one or more embodiments with the understanding that this disclosure is to be considered an exemplification of the principles of the invention and is not intended to limit the disclosure to the illustrated embodiments. Aspects of the different embodiments can be combined with or substituted for one another.

As will be appreciated, terms such as "left" and "right", "top" and "bottom," "vertical" and "horizontal", and "front" and "rear" (etc.), used as nouns, adjectives or adverbs refer in this description to the orientation of the structure of the hutch as it is illustrated in the various views. Such terms are not intended to limit the invention to a particular orientation. Also, fold lines in the drawings may be depicted as either broken or solid lines.

Turning to the drawings, where like numerals indicate like elements, there is shown in FIG. 1 a perspective view of a display hutch 10 according to the disclosure. The display hutch 10 comprises a hutch body 24 and a top tray 101. The hutch body 24 is made from three blanks while the top tray 101 is made from a separate (fourth) blank 100.

The hutch body 24 comprises four major panels, that is, a front panel 12, two side panels 14 and a rear panel 16 (obscured in FIG. 1), as well as an internal support 20 and shelves 22. Each shelf 22 may have a load bearing surface and corresponds to a level. The display hutch 10 shown in FIG. 1 has three levels, although the display hutch 10 may be made with any number of levels.

Each panel 12, 14, 16 generally extends vertically (bottom to top) from a bottom edge 26 resting on the ground to a top edge 28 located just below the top tray 101. The various surfaces of the hutch 10, especially the large uninterrupted surfaces of the side panels 14, may bear graphics and other information about the products on display.

The display hutch 10 may be a substantially rectilinear structure and may have four vertical corners, namely, a left front corner 36, a right front corner 38, a left rear corner 40 and a right rear corner 42. The front panel 12 of the hutch 10 extends laterally from the left front corner 36 to the right front corner 38. The left side panel 14 extends front to back from the left front corner 36 to the left rear corner 40. The right side panel 14 extends front to back from the right front corner 38 to the right rear corner 42. And the rear panel 16 extends laterally from the left rear corner 40 to the right rear corner 42.

The front panel 12 comprises a substantially rectangular front panel body 13 that defines a plurality of openings or windows 30, one per level, through which products (not shown) may be seen and accessed. Each side panel 14 is a planar, uninterrupted surface, lacking any significant openings or windows. The rear panel 16 comprises a rear panel body 17 that defines a plurality of openings or windows 30 through which products may be seen and accessed. Thus, the display hutch 10 may present two (front and rear) "shoppable" sides, that is, two sides through which products may be seen and accessed, and two "uninterrupted" surfaces, the uninterrupted surfaces being the side panels 14.

The front panel body 13 and the rear panel body 17 may include upwardly projecting front tabs 45 and rear tabs 45 at each level to help hold products or a tray full of products on the respective shelves 22.

Each shelf 22 may comprise two separate panels: a front shelf panel 44 and a rear shelf panel 72. Each front shelf panel 44 is hingedly connected to the front panel body 13 along a front shelf fold line 54 and may be supported at its distal (free) edge 56 by the internal support 20. Each rear shelf panel 72 is hingedly connected to the rear panel body 17 along a rear shelf fold line 74 and may be supported at its distal (free) edge 76 by the internal support 20. Thus, each shelf 22 is supported by the front panel body 13, the rear panel body 17 and the internal support 20.

The internal support 20 is substantially tall and narrow and extends vertically between the front shelf panels 44 and the rear shelf panels 72. The internal support 20 is made from two blanks or rails 88 and so is two layers thick. A front rail 88 may be adhered to the front panel 12 and, more specifically, to front glue tabs 66 that are hingedly affixed to every front shelf panel 44. Likewise, a rear rail 88 may be adhered to the rear panel 16 and, more specifically, to rear glue tabs 66 that are hingedly affixed to every rear shelf panel 72. As the display hutch 10 is erected, the front rail 88 and the rear rail 88 come together in the middle of the structure to form the internal support 20.

The internal support 20 may be located equidistant the front panel 12 and the rear panel 16 and equidistant the two side panels 14. Preferably the internal support 20 extends to the ground. In order to extend to the ground, each rail 88 may extend below the lowest glue tabs 66 a distance equal to the distance from the lowest shelf 22 to the ground.

Figure 10:
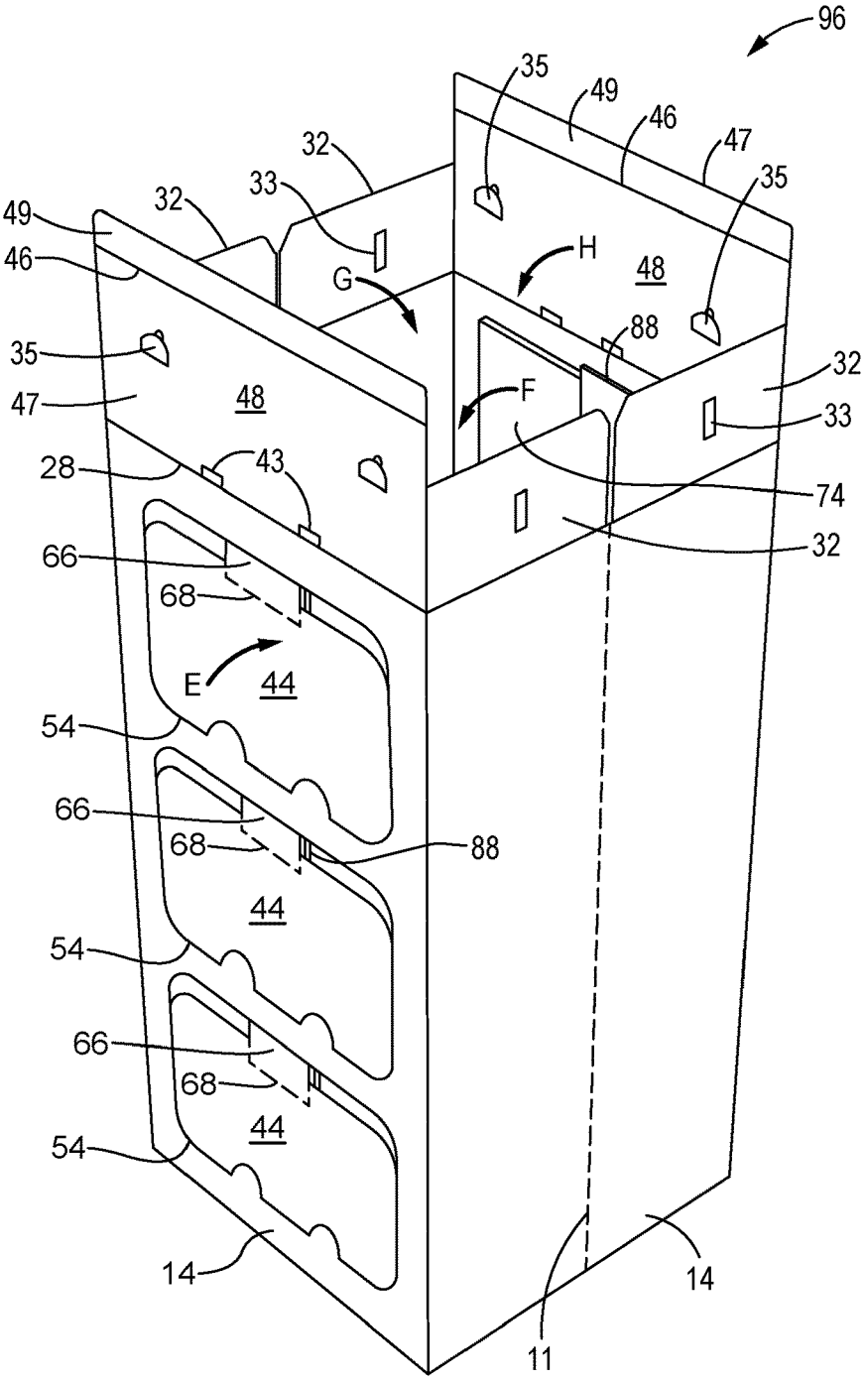
FIG. 10 is a front perspective view of the structure of FIG. 7 after being positioned upright and unfolded ("squared up") to create an upright structure.
Figure 11:
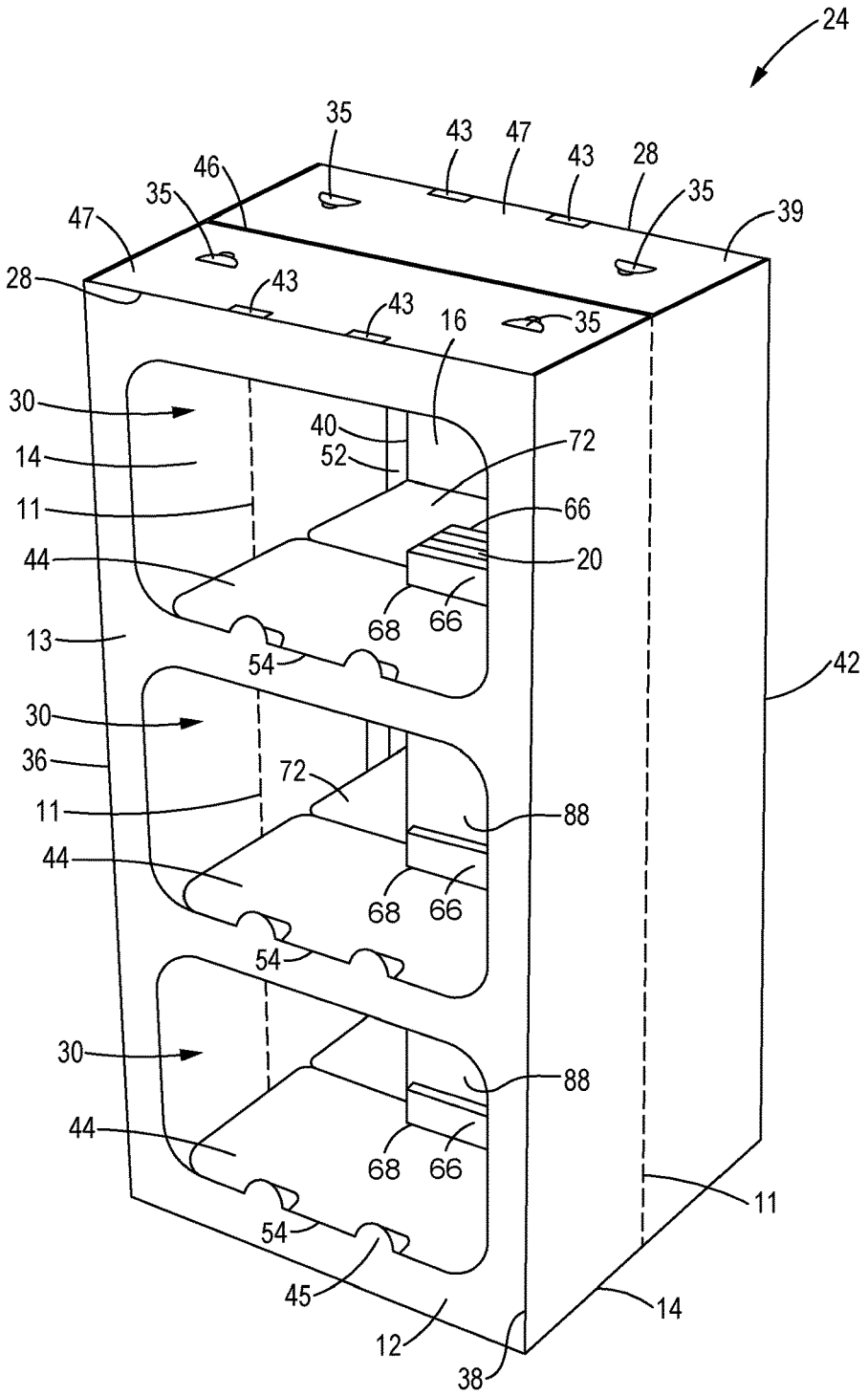
FIG. 11 is a front perspective view of the upright structure of FIG. 10 after all the side shelf panels and the top flaps have been rotated and locked into place.

The hutch body 24 may further comprise a top wall 39 which is obscured by the top tray 101 in FIG. 1 but visible in FIG. 11. The top wall 39 comprises one or more top flaps 47 affixed to the front panel 12 and the rear panel 16. The top wall 39 may also comprise one or more small flaps 32 (obscured in FIG. 11 but visible in FIG. 10) affixed to one or both side walls 14.

The top tray 101 shown in FIG. 1 may be affixed to the hutch body 24 via top tray tabs 132 and top wall slots 43. The top tray tabs 132 are formed in the bottom wall 102 of the top tray 101 and fit within the top wall slots 43 defined by (formed in) the hutch body top wall 39. More specifically, the top wall slots 43 may be defined by the top flaps 47.

First (Body) Blank 50

Figure 2:
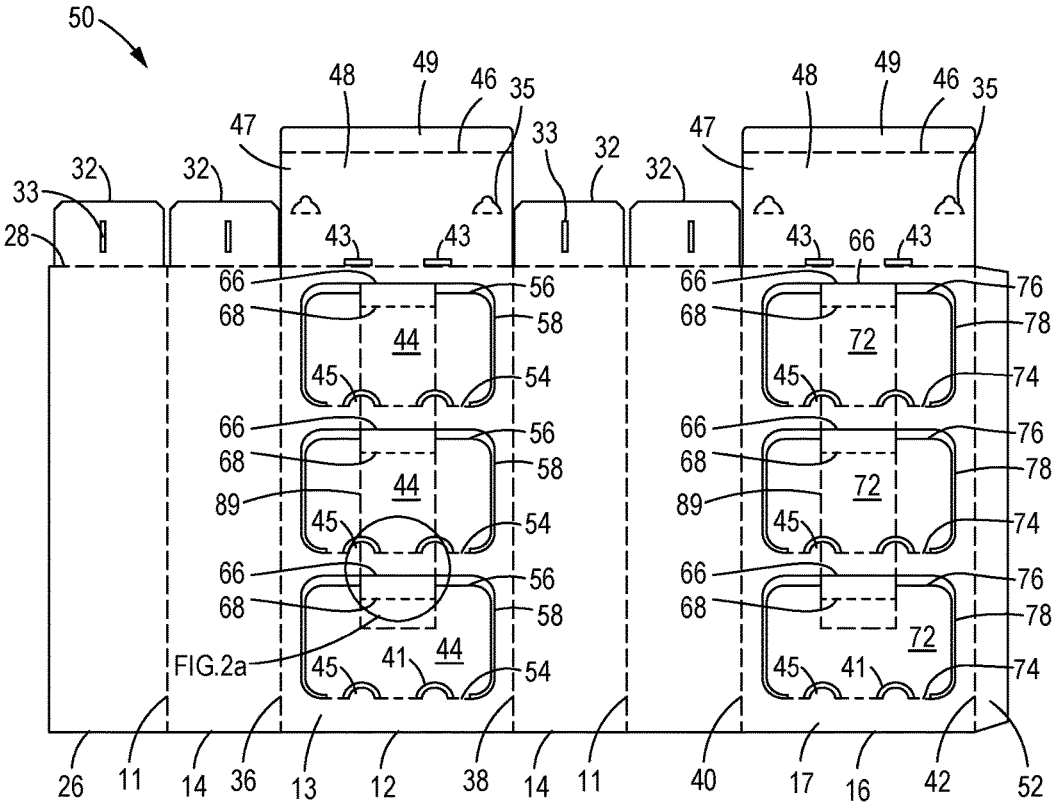
FIG. 2 is a plan view of a first blank used to make the display hutch of FIG. 1.

FIG. 2 is a plan view of a first blank 50 used to make the display hutch 10 of FIG. 1. The first blank 50 may be made from any suitable material, but corrugated board is preferred for its combination of strength, light weight and recyclability. The first blank 50 is shown cut and scored from a single piece of corrugated board to the desired shape, and comprises four major panels, a glue flap 52, small flaps 32 and top flaps 47. The four major panels are the front panel 12, the two side panels 14 and the rear panel 16. Each of the four major panels extends from a bottom edge 26 to a top edge 28.

The front panel 12 is attached to one side panel 14 by a left front (first) fold line 36 corresponding to the left front corner 36 and to the other one side panel 14 by a second fold line 38 corresponding to the right front corner 38. The rear panel 16 is attached to one side panel 14 by a third fold line 40 corresponding to the left rear corner 40 and to the glue flap 52 along a fold line 42 corresponding to the right rear corner 42.

The left side panel 14 may be foldably attached to the front panel 12 by a left front corner fold line 36 corresponding to the left front corner 36 and to the rear panel 16 by the glue flap 52. The right side panel 14 may be attached to the front panel 12 by a right front corner fold line 38 corresponding to the right front corner 38 and to a left rear corner fold line 40 corresponding to the left rear corner 40 in the finished hutch 10.

Of course, other arrangements of the major panels are possible. The glue flap 52 may be foldably attached to any major panel and upon assembly of the hutch 10 may be affixed with glue or other adhesive to a different major panel. For example, the glue flap 52 may be foldably attached to the left side panel 14 and affixed to the rear panel 16. Also, the major panels can be arranged with both side panels 14 foldably attached to the rear panel 16. It should be understood that this disclosure is not limited to the particular panel arrangement shown in the drawings.

Still referring to FIG. 2, the front panel 12 comprises a ladder shaped front panel body 13 and one or more front shelf panels 44. Each front shelf panel 44 is attached to the front panel body 13 along a horizontally oriented front shelf fold line 54. Rotating each front shelf panel 44 inwardly along a front shelf fold line 54 creates a front window 30 in the assembled display hutch 10. Thus each front shelf panel 44—and each front window 30—may be at least partly defined by a substantially U-shaped cut line 58 that extends upwardly from one lateral end of the front shelf fold line 54 to the opposite lateral end. At each level of the hutch 10, the front shelf fold line 54 may be co-linear with the rear shelf fold line 74. Each front shelf panel 44 may be substantially rectangular. A front glue tab 66 may be attached to each front shelf panel 44 along a glue tab fold line 68. The front glue tabs 66 are configured to be adhered to a front rail 88 as explained below.

Each side panel 14 may be substantially rectangular. A side panel fold line (side knockdown score) 11 may vertically bisect each side panel 14.

The rear panel 16 includes a ladder shaped rear panel body 17 and one or more rear shelf panels 72. Each rear shelf panel 72 is attached to the rear panel body 17 along a horizontal rear shelf fold line 74. Rotating each rear shelf panel 72 inwardly along a rear fold line 74 creates a rear window 30 in the assembled display hutch 10. Thus each rear shelf panel 72—and each rear window 30—may be at least partly defined by a substantially U-shaped cut line 78 that extends upwardly from one lateral end of the rear shelf fold line 74 to the opposite lateral end. Each rear shelf panel 72 may be substantially rectangular. A rear glue tab 66 may be attached to each rear shelf panel 72 along a glue tab fold line 68. The rear glue tabs 66 are configured to be adhered to a rear rail 88 as explained below.

The first blank 50 may include upwardly projecting front tabs 45 and rear tabs 45. More specifically, each front shelf fold line 54 and each rear shelf fold line 74 may be interrupted by one or more preferably semicircular tab score lines 41 to create one or more front tabs 45 and one or more rear tabs 45.

During assembly of the hutch 10, the two rails 88 are glued to the first blank 50 in the positions indicated by the dashed lines 89 in FIG. 2.

One or more small flaps 32 are attached to each side panel 14 along a top edge fold line 28 corresponding to the top edge 28 of the hutch 10. Each small flap 32 may define one or more small flap slots 33, the purpose of which is explained below.

A top flap 47 is attached to each of the front panel 12 and the rear panel 16 along the top edge fold line 28 corresponding to the top edge of the hutch 10. Each top flap 47 may include a main flap 48 and a facing flap 49 attached to the main flap along a top flap fold line 46. The top flap 47 may define one or more top wall slots 43 configured to receive top tray tabs 132 extending downward from the top tray 101. The top flap 47 may also comprise one or more locking tabs 35 that may be inserted into the small flap slots 33 defined by the small flaps 32.

Figure 2A:
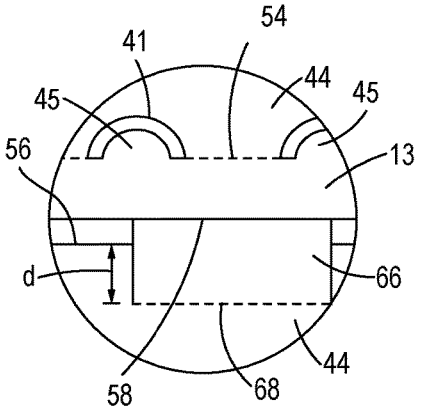
FIG. 2*a* is a close up view of a portion of the first blank of FIG. 2.

FIG. 2*a* is a close up view of a portion of the first blank of FIG. 2. The horizontal portion of the glue tab fold line 68 is located a distance (d) below the front distal edge 56 of each front panel 44. This distance (d) may be about equal to the thickness of the front glue tab 66 and the front rail 88. The glue tabs 66 and glue tab fold lines 68 of the rear shelf panels 72 are configured in a similar fashion.

Figure 2B:
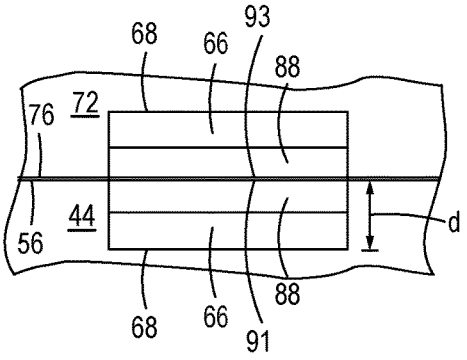
FIG. 2*b* is a top plan view of a portion of the display hutch of FIG. 1.

FIG. 2*b* is a top plan view of a portion of the display hutch of FIG. 1. The front and rear glue tabs 66 are bent backwards along their respective fold lines 68 and in a vertical orientation. The rear facing surface 91 of the front rail 88, that is, the surface facing the rear panel 16, is flush with (co-planar with) the distal edge 56 of each front shelf panel 44, and the front facing surface 93 of the rear rail 88 is flush with the distal edge 76 of each rear shelf panel 44. Also, the front and rear rails 88 may abut each other along their respective rear and front facing surfaces 91, 93. The front distal edge 56 of each front shelf panel 44 may come into close proximity to or even contact a corresponding rear distal edge 76 so that each shelf 22 forms a solid (uninterrupted) loading surface.

Second (Rail) Blanks

Figure 3:
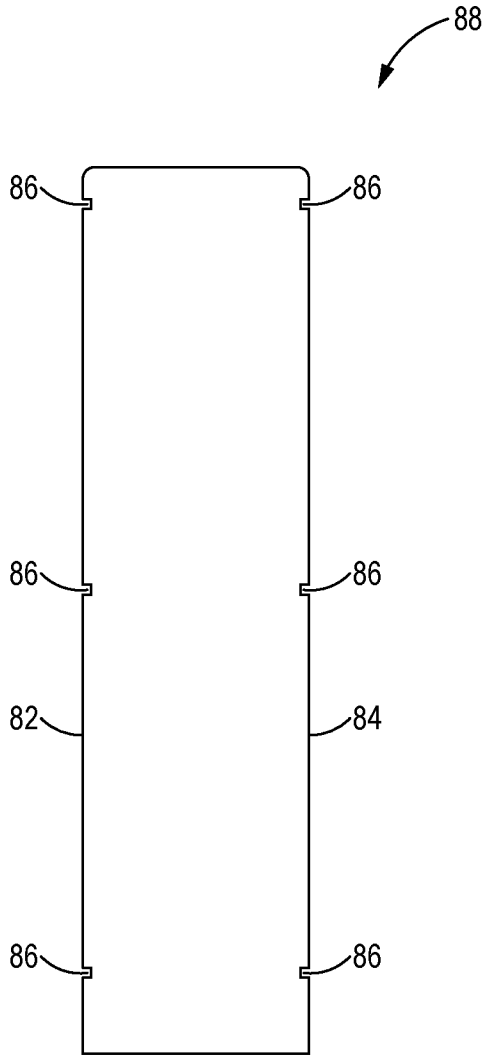
FIG. 3 is a plan view of a second blank, two of which may be used to make components of the display hutch of FIG. 1.

Two second (rail) blanks 88 may be used to form the internal support 20. Each second blank 88 may be substantially rectangular as shown in FIG. 3. Each second blank 88 may have a height at least as great as the distance between two of the glue tabs 66, and preferably at least as great as the distance between the bottommost glue tab 66 and the topmost glue tab 66. Each second blank 88 may have a vertical first edge 82 and a vertical second edge 84. The edges 82 of two blanks 88 come together in the assembled display hutch 10 to form the edge 82 of the internal support 20. Likewise, the second edges 84 of two blanks 88 come together in the assembled display hutch 10 to form an edge 84 of the internal support 20. The first edge 82 and the second edge 84 may each define a series of vertically spaced apart notches 86.

Third (Top Tray) Blank

Figure 4:
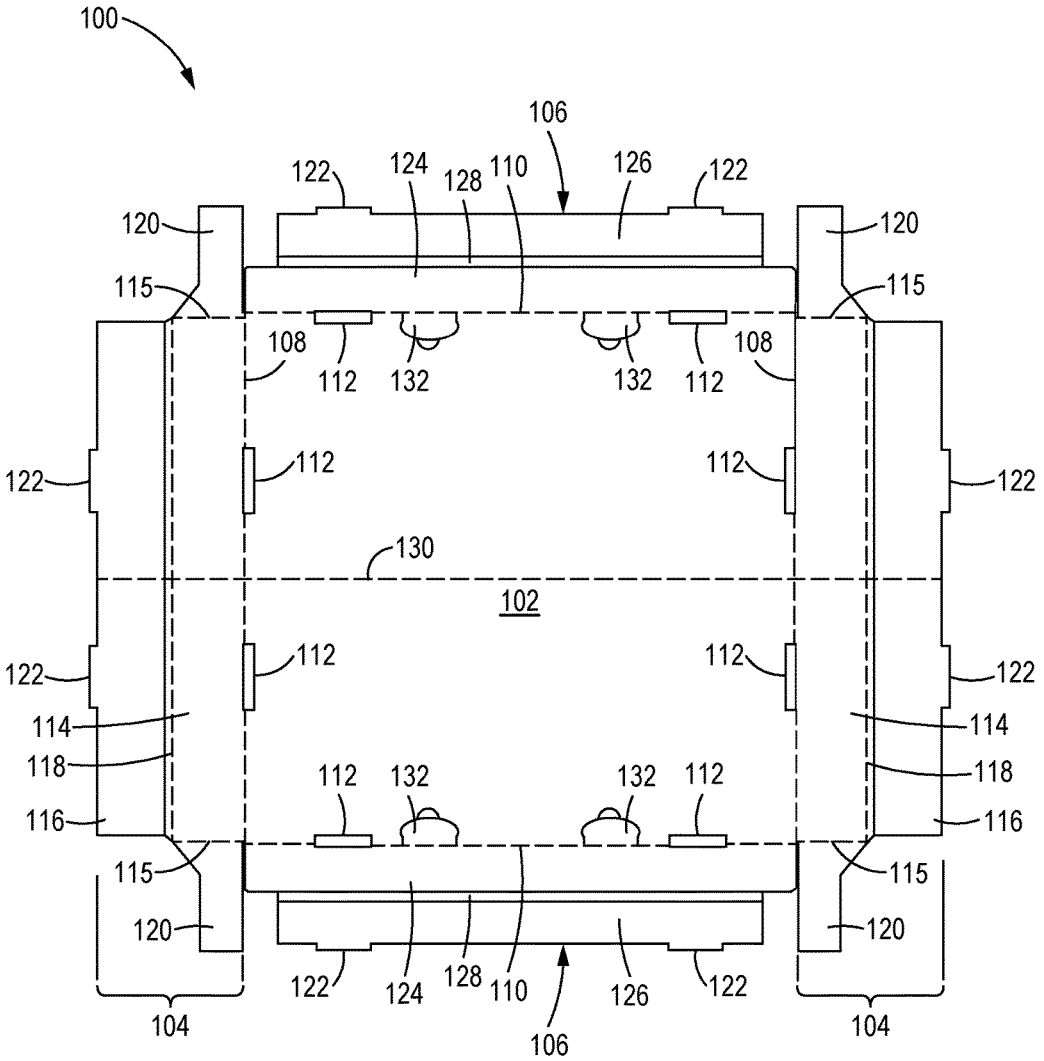
FIG. 4 is a plan view of a third blank that may be used to make the top tray of FIG. 1.

FIG. 4 is a plan view of a third blank 100 that may be used to make the display hutch 10 of FIG. 1. The third blank 100 may be used to form the top tray 101 that is mounted on top of the hutch 10. The blank 100 may be made from any suitable material, but corrugated board is preferred. The blank 100 is shown cut and scored from a single piece of corrugated board to the desired shape, and comprises a rectangular bottom panel 102, two opposing side wall assemblies 104 and opposing front and rear wall assemblies 106. The rectangular bottom panel 102 is defined by parallel, opposing side fold lines 108 and parallel, opposing front and rear end fold lines 110. One or more bottom wall slots 112 may be disposed in the bottom panel 102 adjacent the side fold lines 108 and the front and rear fold lines 110.

Each side wall assembly 104 extends outward from the bottom panel 102 along a side fold line 108. Each side wall assembly 104 comprises an elongated, substantially rectangular exterior side panel 114—so called because it forms the exterior of the side wall 105 in the assembled tray 101—attached to the bottom panel 102 along the side fold line 108 and an elongated, substantially rectangular interior side panel 116 connected to the exterior side panel 114 along parallel double side fold lines 118. Flaps 120 extend from either end 115 of the exterior side panel 114. Tabs 122 extend from each interior side panel 116 and are located and configured to be inserted into corresponding bottom wall slots 112 in the finished top tray 101.

Each front and rear wall assembly 106 extends outward from the bottom panel 102 along an end fold line 110. Each front and rear wall assembly 106 may comprise an elongated, substantially rectangular exterior panel 124—so called because it forms the exterior of the front or rear wall 107 in the assembled tray 101—attached to the bottom panel 102 along an end fold line 110 and an elongated substantially rectangular interior end panel 126 connected to the exterior end panel 124 along parallel double end fold lines 128.

Tabs 122 extend from each interior end panel 126 and are located and configured to be inserted into corresponding bottom wall slots 112 in the finished top tray 101. A top tray fold line 130 may bisect the top tray blank 100. One or more top tray tabs 132 may be formed in the top tray bottom 102 in locations corresponding to the top wall slots 43 in the hutch body 24. The top tray blank 100 can be folded in half along the top tray fold line 130 prior to shipping.

Method of Assembly

Hutch Body 24 Assembly

Referring to FIG. 2, glue or other adhesive is applied to the interior (rail facing) surfaces of the front and rear glue tabs 66 or, less preferably, to areas of the rails 88 that will be adhered to the front and rear glue tabs 66. After applying the glue, the two rails 88 are positioned onto the first blank 50 in the locations indicated by the dashed lines 89 in FIG. 2. This causes the rails 88 to become affixed to the vertically aligned glue tabs 66 of the front and rear panels 12, 16 to achieve the substantially flat structure 90 shown in FIG. 5.

Figure 5:
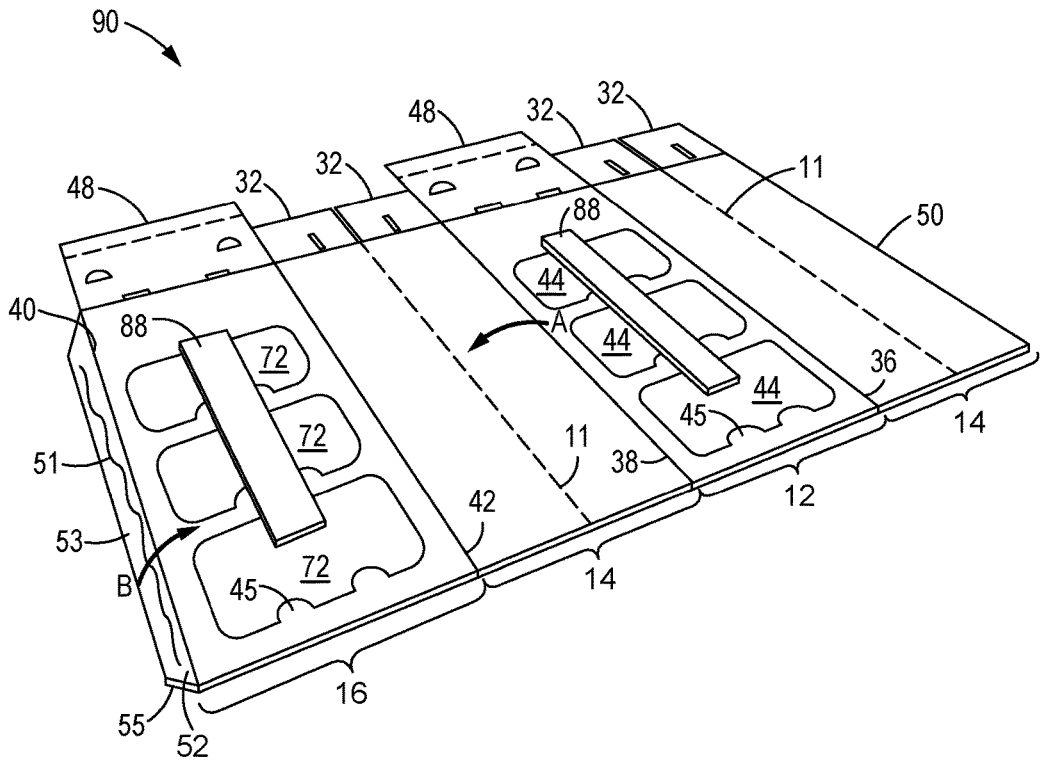
FIG. 5 is a perspective view of two second banks affixed to the first blank to create a flat structure.

Next, as shown in FIG. 5, glue 51 or other adhesive may be applied to the inner facing surface 53 of the glue flap 52. The flat structure 90 may be folded over along the fold line 38 as shown by arrow A in FIG. 5 and then folded over along the fold line 40 as shown by arrow B until the glue flap 52 lays flat against the outer facing surface of the left side panel 14 and is adhered thereto to form the glued structure 92 of FIG. 6.

Alternatively, the glue 51 or other adhesive may be applied to the outer facing surface 55 of the glue flap 52. Then the flat structure 90 may be folded over along the fold line 40 as shown by arrow B in FIG. 5 and then folded over along the fold line 38 as shown by arrow A until the glue flap 52 lays flat against the inner facing surface of the left side panel 14 and is adhered thereto to form a glued structure 92 like that of FIG. 6.

Figure 6:
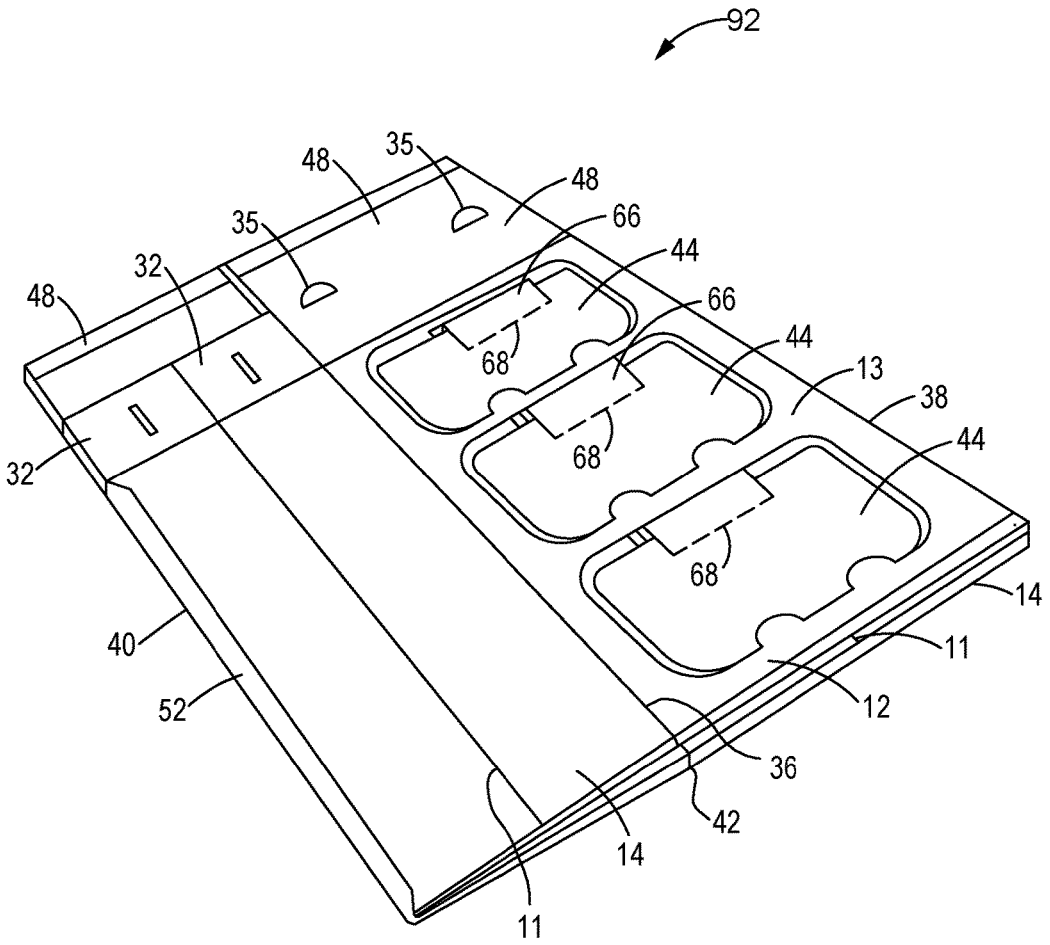
FIG. 6 is a perspective view of the flat structure of FIG. 5 after being folded and glued.

The glued structure 92 may be shipped in the configuration shown in FIG. 6. If desired, the glued structure 92 may be made even more compact. This may be achieved by squaring up (opening up) the structure 92 of FIG. 6 so that it assumes a three dimensional right prism shape (like that shown in FIG. 11), then pushing the side panels 14 inwardly along the side panel fold lines 11. This pushing/folding step will cause the side panels 14 to fold inwardly on themselves and become sandwiched between the front panel 12 and the rear panel 16 to achieve the compact structure 94 shown in FIG. 7. The compact structure 94 has a width about the same as the front panel 12 (or, for that matter, the rear panel 16) and is much more compact than most traditional hutches. The compact structure 94, along with a folded top tray blank 100, may be shipped to the end user in this configuration.

Top Tray Assembly

Figure 8:
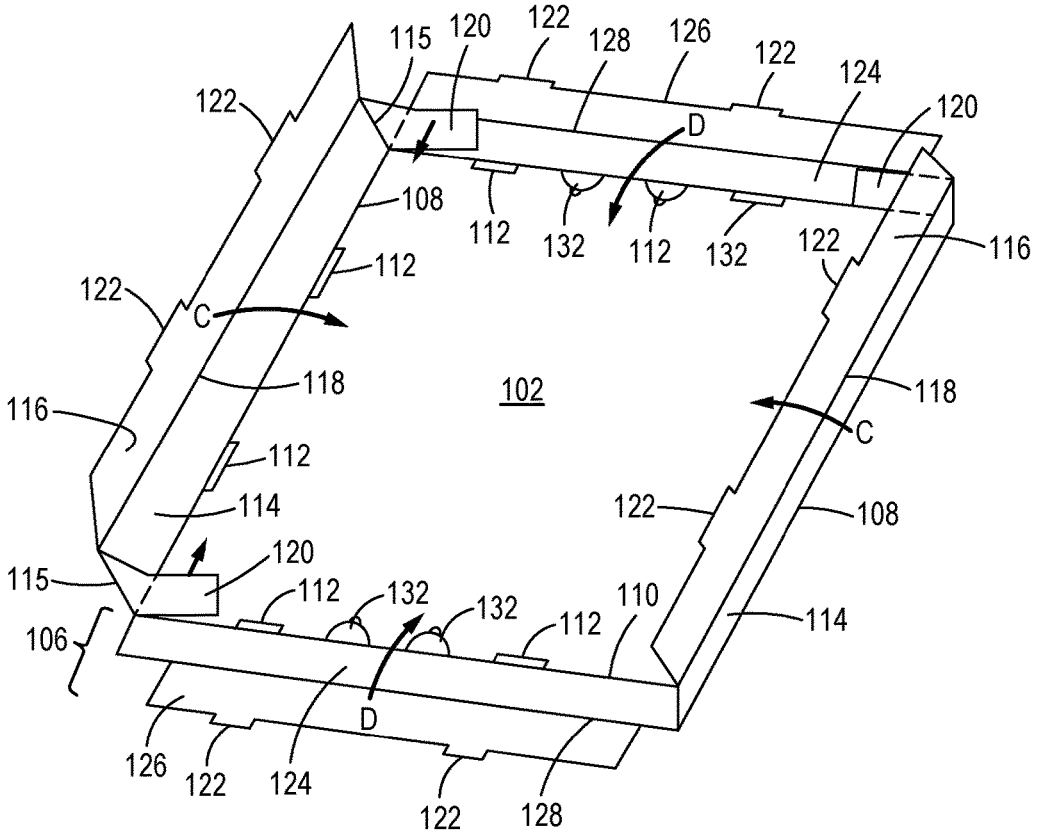
FIG. 8 is a perspective view of the blank of FIG. 4 shown partially assembled into a top tray.

The top tray 101 may be assembled from the blank 100 of FIG. 2 in the following manner. As shown in FIG. 8, the side walls 105 are formed by first rotating each side wall assembly 104 inwardly (in the direction of arrow C) along the side fold line 108 until it is substantially perpendicular to the bottom panel 102. The flaps 120 are folded inwardly (toward each other as shown by the arrows) along end fold lines 115 until they are perpendicular to the exterior side panel 114 and aligned with a respective front or rear end fold line 110. The interior side panels 116 are then folded inwardly along the double side fold lines 118 until the interior side panels 116 are in facing, abutting relationship with the exterior side panels 114. The tabs 122 may be inserted into the bottom wall slots 112.

Next, the front wall 107 and the rear wall 107 each are assembled in a similar manner by first rotating each wall assembly 106 inwardly (in the direction of arrow D) along the first end fold line 110 until they are substantially perpendicular to the bottom panel 102. Then the interior end panels 126 are folded inwardly along the double end fold lines 128 until the interior end panels 126 are in facing, abutting relationship with the exterior end panels 124. The tabs 122 may be inserted into the bottom wall slots 112. The flaps 120 should be captured between the exterior end panels 124 and the interior end panels 126.

Figure 9:
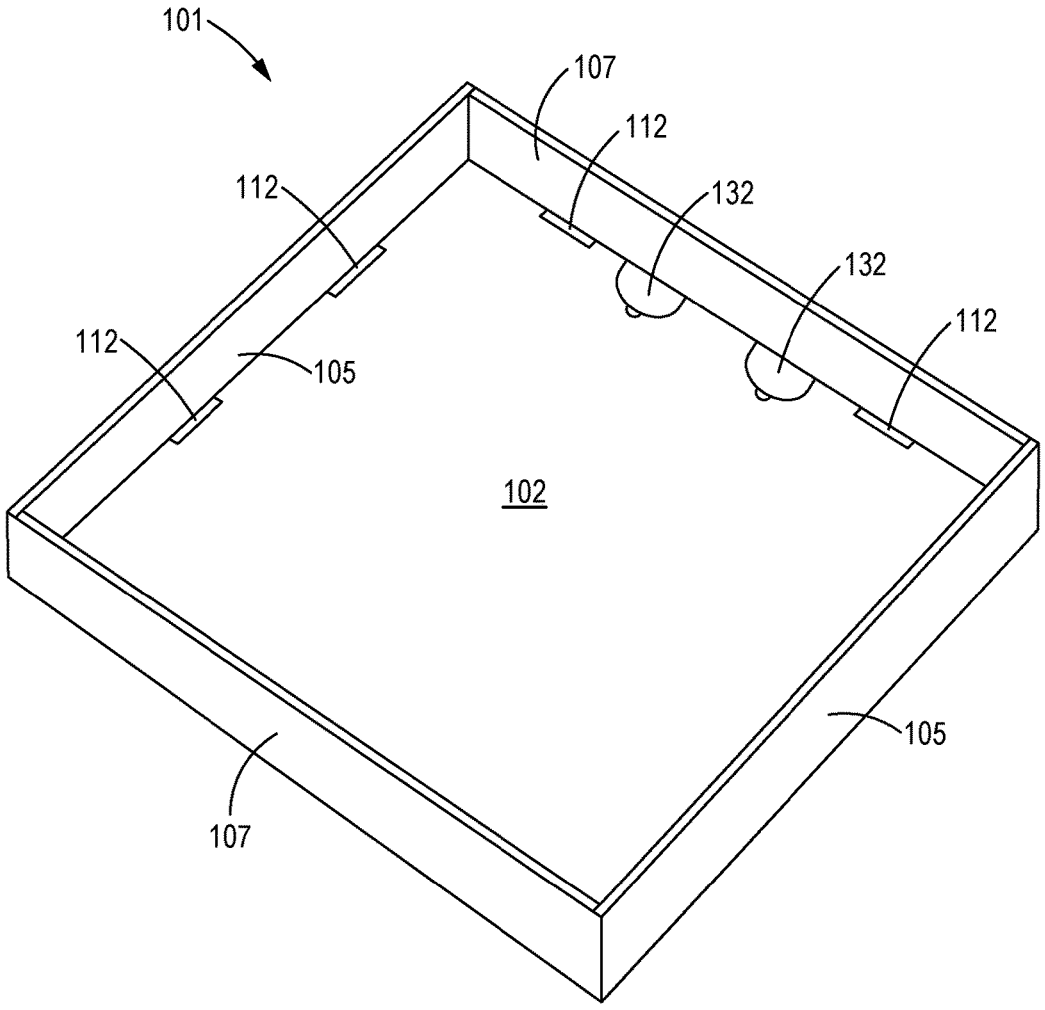
FIG. 9 is a perspective view of a fully assembled top tray.

The assembled top tray 101, shown in FIG. 9, is a lightweight, rigid structure that can be mounted on top of the hutch 10 as explained below.

Hutch Assembly

Figure 7:
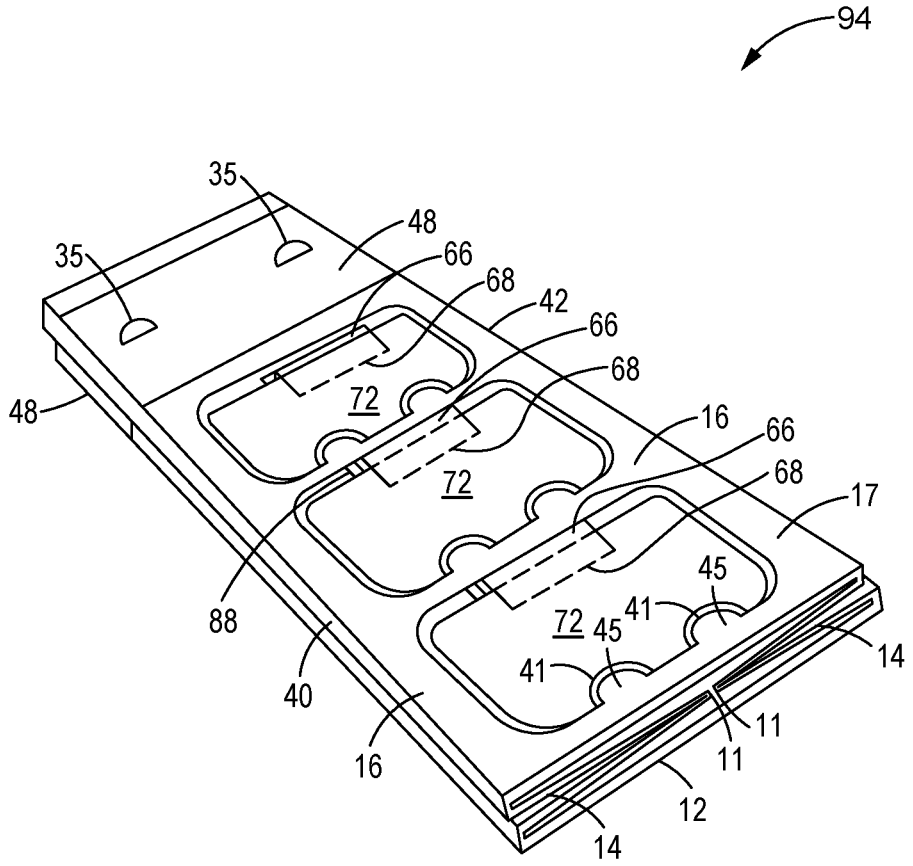
FIG. 7 is a perspective view of the structure of FIG. 6 after being further folded to form a more compact structure.

To assemble (set up) the hutch 10 at, for example, its final destination, starting with the compact structure 94 of FIG. 7, the compact structure 94 may be positioned upright and the front panel 12 and the rear panel 16 pulled outwardly to form the "squared up" three-dimensional upright structure 96 of FIG. 10. In this configuration the two rails 88 that have been adhered to the front and rear glue tabs 66 are spaced apart by approximately the front-to-back depth of the compact structure 94.

Next, the front shelf panels 44 may be rotated downwardly along front shelf fold lines 54 in unison. This may be accomplished by pushing inwardly and downwardly any of the front shelf panels 44 along its respective front shelf fold line 54 in the direction of arrow E in FIG. 10, and/or by pushing down on the front rail 88. Likewise, the rear shelf panels 72 may be rotated downwardly along rear shelf fold lines 74 in unison by pushing inwardly and downwardly any of the rear shelf panels 44 along its respective rear shelf fold line 74 in the direction of arrow F in FIG. 10, and/or by pushing down on the corresponding rear rail 88. These two actions bring together the two rails 88 to form the internal support 20 shown in FIG. 11.

Next, each small flap 32 may be folded inwardly in the direction of arrow G until it assumes a horizontal orientation. Each of the front and rear top facing flaps 49 may be folded inwardly along top flap fold line 46 until it is perpendicular to its respective front or rear main flap 48. Then each front and rear top flap 47 is rotated inwardly about its respective top edge fold line 28 in the direction of arrow H until it assumes a horizontal orientation, preferably adjacent a corresponding pair of small flaps 32. Each locking tab 35 may be pushed downward and inserted into a corresponding small flap slot 33 to lock the top flaps 47 and the small flaps 32 together.

FIG. 11 is a front perspective view of the upright structure 96 of FIG. 10 after the shelf panels 44, 72 have been folded downward into a horizontal orientation and the top flaps 47 have been folded down to create a top wall 39.

Finally, the assembled top tray 101 of FIG. 9 may be mounted onto the top wall 39 of the hutch body 24. Prior to placing the top tray 101 on the top wall 39, the top tray tabs 132 may be pushed downward so that they can be inserted into the top wall slots 43 in the top of the hutch body 24. The display 10 is now fully assembled and appears substantially like the hutch 10 of FIG. 1.

INDUSTRIAL APPLICABILITY

The hutch 10 can be used to display any suitable product, in a retail setting or otherwise. The hutch is durable and can bear significant loads, especially if made of corrugated board. With knockdown scores on the side panels, the hutch can be folded into a compact configuration about half the size of some traditional hutches.

It should be understood that the embodiments described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A display hutch comprising:

a front panel comprising a front panel body that defines a plurality of windows and one or more front shelf panels rotatably attached to the front panel body along front shelf fold lines, the front panel extending from a left front corner to a right front corner, each front shelf panel having a front distal edge parallel to the front shelf fold line;

a left side panel extending from the left front corner to a left rear corner;

a right side panel extending from the right front corner to a right rear corner;

a rear panel extending from the left rear corner to the right rear corner, the rear panel comprising a rear panel body that defines a plurality of windows and one or more rear shelf panels rotatably attached to the rear panel body along rear shelf fold lines, each rear shelf panel having a rear distal edge parallel to the rear shelf fold line;

one or more shelves, each shelf comprising one of the front shelf panels and one of the rear shelf panels;

a front glue tab hingedly affixed to each front shelf panel;

a rear glue tab hingedly affixed to each rear shelf panel;

a top wall comprising one or more top flaps affixed to one or both of the front panel and the rear panel; and an internal support comprising a vertically extending front rail adhered to each front glue tab and a vertically extending rear rail adhered to each rear glue tab.

2. The display hutch of claim 1 further comprising front tabs projecting upwardly from each front shelf fold line and rear tabs projecting upwardly from each rear shelf fold line.

3. The display hutch of claim 1 wherein:

the front rail comprises a rear facing surface flush with the distal edge of each front shelf panel; and the rear rail comprises a front facing surface flush with the distal edge of each rear shelf panel.

4. The display hutch of claim 3 wherein a rear facing surface of the front rail abuts a front facing surface of the rear rail.

5. The display hutch of claim 4 wherein the front distal edge of each front shelf panel contacts a corresponding rear distal edge of each rear shelf panel.

6. The display hutch of claim 1 wherein the front panel, the left side panel, the right side panel, the rear panel and the shelves are formed from a single folded unitary first blank.

7. The display hutch of claim 1 wherein the front rail and the rear rail are each formed from an identical blank.

8. The display hutch of claim 1 wherein:

each side panel is vertically bisected by a side panel fold line; and the display hutch is re-configurable from a first configuration in which the front panel, the side panels and the rear panel are squared up and form a right prism, and a second configuration in which the side panels are folded along their respective side panel fold lines and are sandwiched between the front panel and the rear panel.

9. The display hutch of claim 1 further comprising a glue flap foldably attached to a panel selected from the group consisting of the front panel, the left side panel, the right side panel and the rear panel, and wherein the glue flap is affixed to a different panel selected from the group consisting of the front panel, the left side panel, the right side panel and the rear panel.

10. The display hutch of claim 1 wherein the display hutch extends upward from a ground-contacting bottom edge and the internal support contacts the ground.

11. The display hutch of claim 1 further comprising a top tray affixed to the top wall.

12. The display hutch of claim 11 wherein:

the top tray has a bottom wall comprising top tray tabs; and the top tray tabs fit within slots defined by the top wall.

* * * * *